US006679044B2

(12) United States Patent
Anderegg

(10) Patent No.: US 6,679,044 B2
(45) Date of Patent: Jan. 20, 2004

(54) PNEUMATIC SPINNING APPARATUS

(75) Inventor: Peter Anderegg, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 86 days.

(21) Appl. No.: 10/015,547

(22) Filed: Dec. 13, 2001

(65) Prior Publication Data

US 2003/0110755 A1 Jun. 19, 2003

(30) Foreign Application Priority Data

Dec. 22, 2000 (CH) ..... 2507/00

(51) Int. Cl.[7] ..... D01H 4/02

(52) U.S. Cl. ..... 57/333; 57/350; 57/315; 57/328

(58) Field of Search ..... 57/5, 328, 331, 57/332, 333, 334, 341, 343, 344, 346, 350, 403

(56) References Cited

U.S. PATENT DOCUMENTS

| | | | | |
|---|---|---|---|---|
| 983,641 | A | | 2/1911 | Pease |
| 2,430,944 | A | | 11/1947 | Noguera |
| 3,217,482 | A | | 11/1965 | Baer |
| 3,702,055 | A | | 11/1972 | Kosaka et al. |
| 3,822,543 | A | | 7/1974 | Edagawa et al. |
| 3,978,648 | A | | 9/1976 | Yamagata et al. |
| 4,112,658 | A | | 9/1978 | Morihashi |
| 4,114,358 | A | | 9/1978 | Tsuchida et al. |
| 4,183,202 | A | | 1/1980 | Morihashi |
| 4,322,944 | A | | 4/1982 | Sraitr et al. |
| 4,412,413 | A | | 11/1983 | Sakai et al. |
| 4,457,130 | A | | 7/1984 | Sakai et al. |
| 4,497,167 | A | | 2/1985 | Nakahara et al. |
| 4,713,931 | A | | 12/1987 | Morrison et al. |
| 4,827,710 | A | | 5/1989 | Nishimura |
| 4,845,932 | A | | 7/1989 | Sakai et al. |
| 4,958,487 | A | | 9/1990 | Suganuma et al. |
| 4,986,066 | A | | 1/1991 | Morrison |
| 5,088,265 | A | | 2/1992 | Suganuma et al. |
| 5,146,740 | A | | 9/1992 | Mori |
| 5,159,806 | A | | 11/1992 | Mori et al. |
| 5,211,001 | A | | 5/1993 | Mori |
| 5,263,310 | A | | 11/1993 | Mori |
| 5,295,349 | A | | 3/1994 | Okamoto |
| 5,419,110 | A | * | 5/1995 | Mikami et al. ..... 57/261 |
| 5,528,895 | A | * | 6/1996 | Deno ..... 57/328 |

FOREIGN PATENT DOCUMENTS

| | | | | |
|---|---|---|---|---|
| DE | 4036119 A1 | | 5/1991 | |
| DE | 4105108 A1 | | 8/1991 | |
| DE | 4225243 A1 | | 2/1993 | |
| JP | 5345422 | | 12/1978 | |
| JP | 6385123 | | 4/1988 | |
| JP | 05044117 A | * | 2/1993 | ..... D01H/1/115 |
| JP | 06240521 A | * | 8/1994 | ..... D01H/1/115 |
| JP | 06287824 A | * | 10/1994 | ..... D01H/15/00 |

OTHER PUBLICATIONS

EPO Search Report May 10, 2001.
Patent Abstract–Japan 243089 Sep. 19, 1989.

* cited by examiner

*Primary Examiner*—John J. Calvert
*Assistant Examiner*—Shaun R Hurley
(74) *Attorney, Agent, or Firm*—Dority & Manning

(57) ABSTRACT

A pneumatic spinning apparatus (1) for producing a yarn or thread spun from fibres includes a nozzle block with a hollow room in which a spindle is arranged. At least one jet nozzle serves for generating a rotating air stream in the hollow room. Opposite the spindle a fibre guide member is arranged, which in the yarn forming process serves as a false core. A fibre guide duct within the nozzle block merges into the fibre guide. The fibre guide duct presents a variable cross-section along its length.

17 Claims, 4 Drawing Sheets

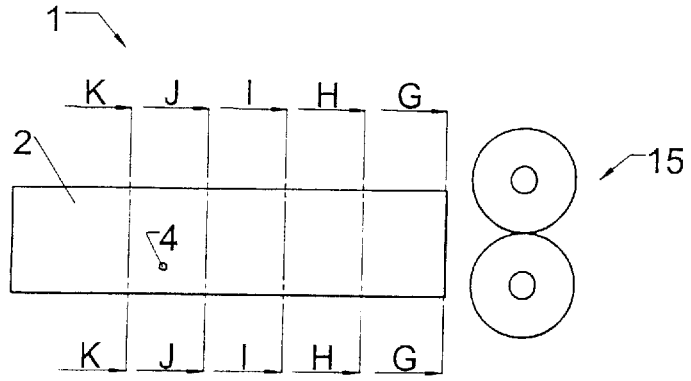
Fig. 4
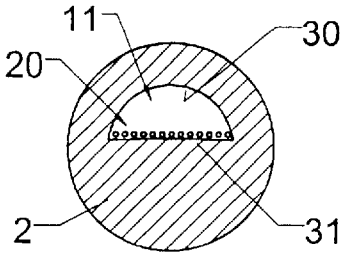
Fig. 5.1
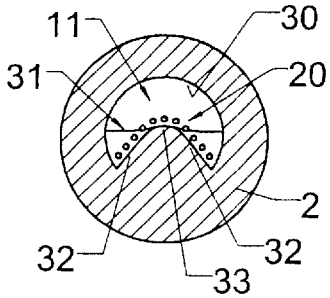
Fig. 5.2
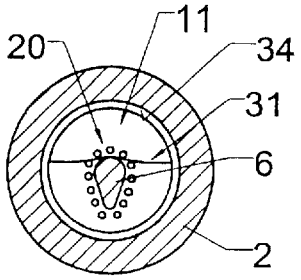
Fig. 5.3
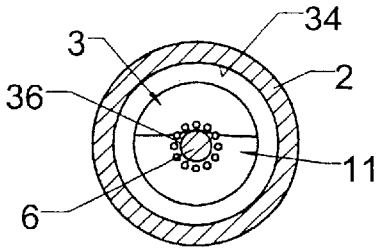
Fig. 5.4
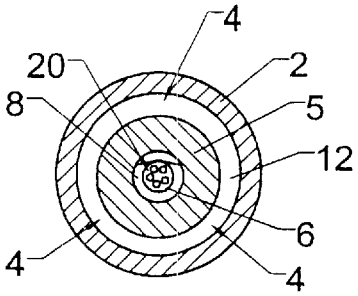
Fig. 5.5

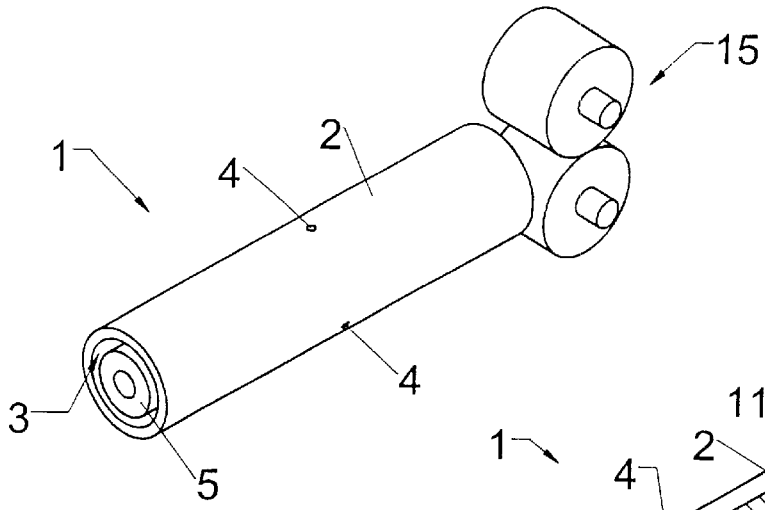
Fig. 6
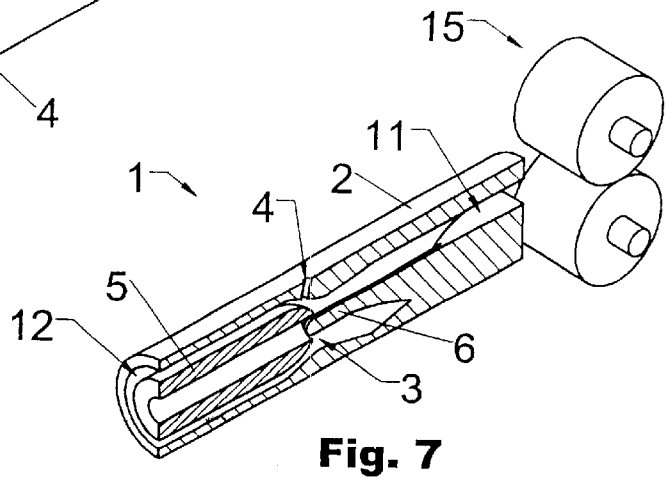
Fig. 7
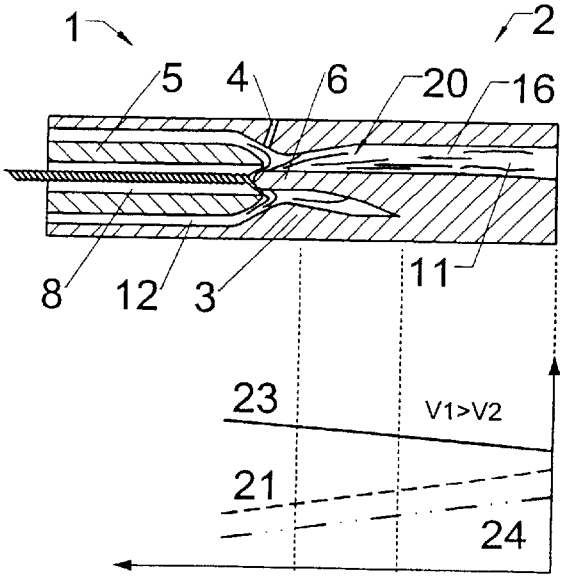
Fig. 8.1
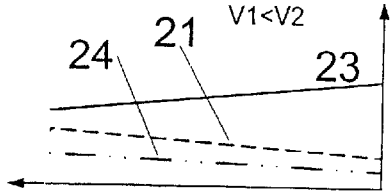
Fig. 8.2
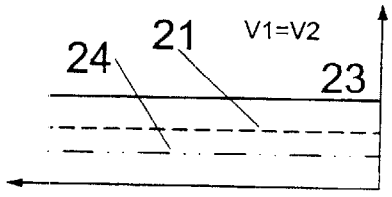
Fig. 8.3

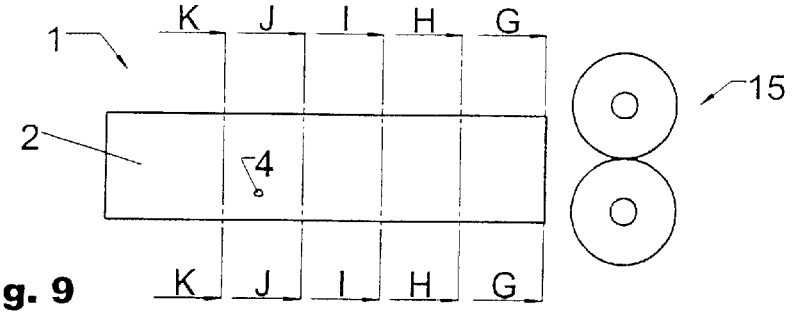
Fig. 9
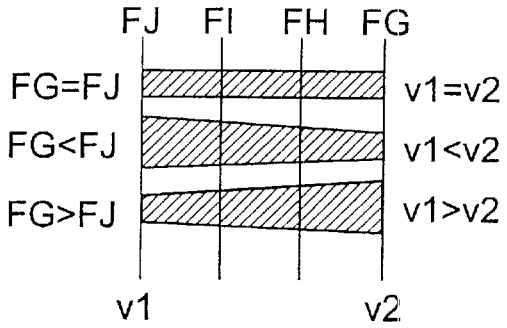
Fig. 10
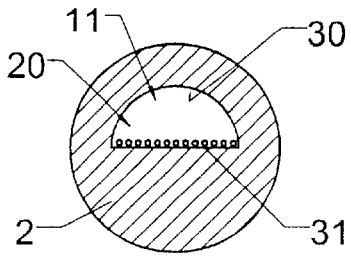
Fig. 11.1
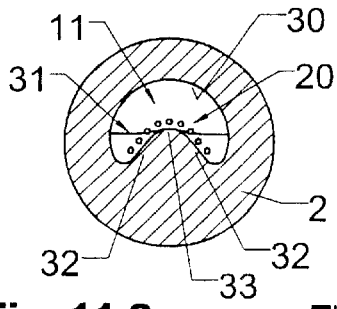
Fig. 11.2
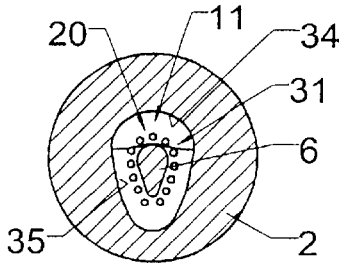
Fig. 11.3
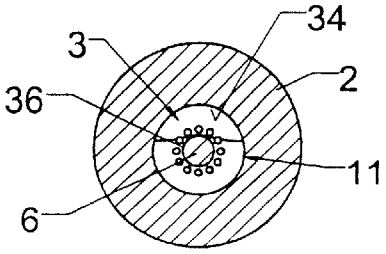
Fig. 11.4
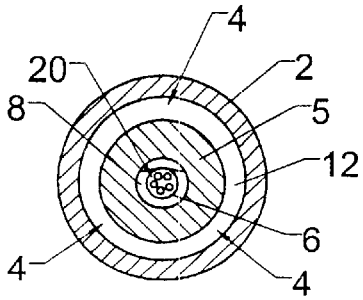
Fig. 11.5

PNEUMATIC SPINNING APPARATUS

BACKGROUND

The present invention concerns a pneumatic apparatus for producing a spun yarn or thread from a fibre array using a vortex flow. From DE 41 05 108 (called DE'108 in the following) a pneumatic spinning device is known for producing a yarn or thread from a short fibre sliver. In a nozzle block presenting a hollow room with a conical support member, the fibres are subject to a rotating air stream and thus are caused to rotate in such a manner that they form a yarn or thread. The yarn is taken off via a spindle duct. At the base of the conical support member a fibre guide duct merges into the nozzle room from the exterior. This fibre guide duct serves for feeding the fibres, or the fibre sliver respectively, from the exterior into the hollow room. A needle-shaped guide element protrudes over the free end of the conical support member, the needle point being oriented towards the centre of the spindle duct of the spindle, which is arranged rotating or stationary. This device presents the disadvantage that the quality of the yarn produced cannot readily be influenced. Due to the layout, in particular of the fibre guide duct, the twist imparted to the fibres by the rotating air stream tends to propagate right into the guide duct. Due to abrupt transitions, particularly between the fibre guide duct and the nozzle room, vortices and turbulences are generated, which exert negative influences. This is a substantial disadvantage. The yarn quality in this arrangement thus does not remain constant, but fluctuates.

From DE 40 36 119 (called DE'119 in the following) a further pneumatic spinning device is known serving for producing a yarn or thread from short fibers. This device also comprises a nozzle block. In its inside, however, as different from the arrangement described in DE'108, no conical support member is provided. Instead of the support member this device comprises a guide element substantially consisting of a wire pointed towards an opening of a rotating or stationary spindle. The function of this arrangement otherwise to a large extent is analogous to the one shown in the DE'108 and thus not discussed in more detail here. This device shows the disadvantage, in particular, that yarn quality substantially cannot be controlled. Because of the uncontrolled airflow supplied into the hollow room and to the zone, to which the fibre sliver is supplied, control of yarn quality is very difficult to achieve.

The arrangements known according to the state of the art are laid out in the zone in which the fibre sliver is fed into the nozzle block, and in the zone in which the fibres are exposed to the rotating air flow, which among other points favours uncontrolled air flows. Turbulences and fluctuating airflows negatively affect the yarn quality and limit the processing speed. The rotational movement generated by the air stream acting onto the fibres furthermore can be controlled with difficulties only and acts rights into the fibre guide duct.

SUMMARY

It is thus a principal objective of the present invention laid open here, to develop the arrangements known according to the state of the art in such a manner that an improved and constant yarn quality is achieved. In particular yarn quality is to be rendered settable and controllable specifically. Additional objects and advantages of the invention will be set forth in the following description, or may be obvious from the description, or may be learned through practice of the invention.

The present invention laid open here shows a pneumatic spinning apparatus for producing a yarn spun from staple fibres. A nozzle block internally contains a hollow room with jet nozzles. In this hollow room a guide means is arranged coaxially opposite a substantially cylindrical spindle, which guide means merges into a fibre guide duct, or comes from it respectively. The fibre guide duct merges into the hollow room from the exterior and serves for feeding fibres, or a fibre sliver respectively, e.g. from a supply device. The layout and the arrangement of the fibre guide duct and of the fibre guide means is of considerable importance for the yarn characteristics and the resulting yarn quality. The fibre feed duct advantageously is laid out under consideration of aerodynamic aspects.

The spindle arranged opposite the fibre guide means is stationary or rotatable and comprises a spindle duct extending substantially centric, which serves for taking off the yarn spun. The fibre guide duct advantageously is arranged laterally offset with respect to the spindle. During processing the fibre sliver supplied by a supply device is brought into the hollow room via the fibre guide duct. In close vicinity of the merging point of the spindle duct the fibres are exposed to a spiraling rotating air stream, which is generated by the jet nozzles arranged substantially tangentially with respect to the spindle and the fibre guide means. In this process the fibres around the fibre guide means are exposed directly to the rotating air stream, which exerts a separating force away from the fibre sliver, acting onto fibre ends not guided in the fibre guide duct. The arrangement of the spindle, of the fibre guide means, and of the fibre guide duct are chosen in such a manner that the leading fibre end (fibre end zone entering the opening of the spindle duct first) of the fibres already forms a yarn while the trailing fibre end (fibre end zone entering the opening of the spindle duct not first) of the fibres is lifted off by the force acting towards the outside. This trailing free end of the fibres is arranged spiraling and rotating about the spindle. In the further course of the fibre sliver processing the fibres gradually are taken in into the spindle duct where they wrap around the fibre guide means in such a manner that a spun yarn with real twist results.

Owing to the fibre guide means and the fibre guide duct laid out and arranged according to the present invention, the fibres of the fibre sliver supplied via the fibre guide duct hardly can wrap around each other in uncontrolled manner. The fibre guide means furthermore functions as a so-called false core, which together with the fibre guide duct laid out and arranged to the present invention controls the propagation of the twist during the yarn formation. In this manner false twisting of fibres is prevented, or that a false twist propagating from the fibre guide means back towards the fibre guide duct in the direction towards the delivery device respectively, which would prevent imparting of real twist at least partially, and would affect yarn quality.

The fibre guide duct and the fibre guide means preferentially are formed continuously and aerodynamically shaped, and depending on the effect to be achieved, are laid out symmetrically or asymmetrically, tapered or bulbous. Other shapes and arrangements of the fibre guide means are possible also.

The layout and the arrangement of the fibre guide duct, via which the fibre sliver or the fibres are fed from the delivery device into the hollow room in the nozzle block, exerts considerable influence onto the processing and onto the resulting yarn. In the fibre guide duct the fibres of the fibre sliver are prepared for the spinning process, being oriented and arranged before they enter the hollow room, and before they are exposed to the rotating air stream. The layout and the cross-section profile along the fibre feed duct determine the manner in which the fibre sliver and the fibres are transformed and prepared. The duct is laid out in such a manner that a controlled air stream, directed from the outside into the nozzle block, prevails inside the duct, and influences the orientation and the arrangement of the fibres. Depending on the layout of the cross-section over the duct length it can be achieved that e.g. the fibres are fed into the process in rather crimped form or in rather straightened form in such a manner that yarns of different characteristics can be produced. The form and the arrangement of the duct also influence the twist imparting process, and the fibre guidance, of the fibres in the spinning process. By specifically designing the fibre guide duct and the air stream conditions therein the constancy of the yarn quality is optimised.

The design of the duct cross-section influences the air stream conditions, the pressure distribution along the duct and the fibre distribution. By specifically guiding the air stream, and if required controlled vortex formation, undesirable twisting of the fibres, particularly in the fibre guide duct, is avoided. Advantageously the fibre guide duct is formed smoothly without abrupt changes in cross-section. Angles and edges, which cause negative air streams, particularly breakdown of the air stream and turbulences, are to be avoided. The fibre guide duct advantageously merges into the fibre guide means smoothly without abrupt transitions.

The fibre guide duct, if required, can be laid out, at least over portions of the length, with various cross-sections and can be provided with additional fibre guide means such as ribs, lamellae or recesses, which assist prevention of fibre twisting. The air stream in the fibre guide duct is controlled and guided, if required, using specific guide means e.g. in the form of lamellae or profiled elements influencing the airflow with the help of pressure differences.

The fibre guide duct along its length presents a variable duct cross-section. The duct is laid out in such a manner that the fibres to be processed are transformed in specific manner and prepared for the spinning process. The fibre guide duct preferentially presents, at least over portions of its lengths, an oval circular, semi-circular, circle-segment, kidney-shaped, heart-shaped, sickle shaped, or half-moon-shaped form, or along its length or in a cross-section presents a combination of these and other forms. Grooves or protrusions extending longitudinally and integrated in the cross-section also are suitable. Using such layouts air pressure and air speed distribution along the duct can be controlled locally. With the help of additional fluid sources or fluid drains, e.g. in the form of nozzles arranged merging into the fibre guide duct, the air stream is controlled specifically as required and the fibre transformation is influenced. The fibre guide duct along its length presents, depending on the requirements, a continuous form, at least over portions of its length, in such a manner that no negative turbulences and air stream breakdowns occur. The wall of the fibre guide duct preferentially merges smoothly into the fibre guide means without abrupt changes in direction. The fibre guide means advantageously extends right into the fibre guide duct or adjoins it.

The yarn formation is effected after the start of a spinning start-up process of any type desired, e.g. by inserting a yarn end of yarn already spun back through the spindle duct into the zone of the spindle intake mouth until fibres of this yarn end are opened by the already rotating air stream to such extent that fibre front ends freshly supplied can be grabbed by this rotating fibre array, and by then pulling back the yarn end inserted, can be held therein, in such a manner that the trailing ends of the freshly supplied fibres can wrap around the leading fibre ends already located in the mouth zone of the spindle duct, in which arrangement the above mentioned yarn with an essentially predetermined piecing can be produced again.

BRIEF DESCRIPTION OF THE DRAWINGS

The present invention is described in the following with reference to the design examples shown in the illustrations.

FIG. 4 a lateral view of the spinning apparatus according to the FIGS. 1 through 3;

FIGS. 5.1 through 5.5 Cross-sections of the spinning apparatus according to the FIG. 4;

FIG. 6 schematically a further spinning apparatus in a perspective view;

FIG. 7 a longitudinal section of the spinning apparatus according to the FIG. 6 in a perspective view;

FIG. 8 a longitudinal section of the spinning apparatus according to the FIGS. 6 and 7 and, as an example, the variation of parameters over the length;

FIG. 9 a lateral view of the spinning apparatus according to the FIGS. 6 through 8;

FIG. 10 a diagram showing the variation of a cross-sectional area over the length;

FIGS. 11 through 11.5 Cross-sections of the spinning apparatus according to the FIG. 9.

DETAILED DESCRIPTION

Reference will now be made in detail to embodiments of the invention, one or more examples of which are shown in the figures. Each example is provided by way of explanation of the invention, and not meant as a limitation of the invention. For example, features illustrated or described as part of one embodiment may be used with another embodiment to yield still a further embodiment. It is intended that the present invention include such modifications and variations and others.

Figure 1:
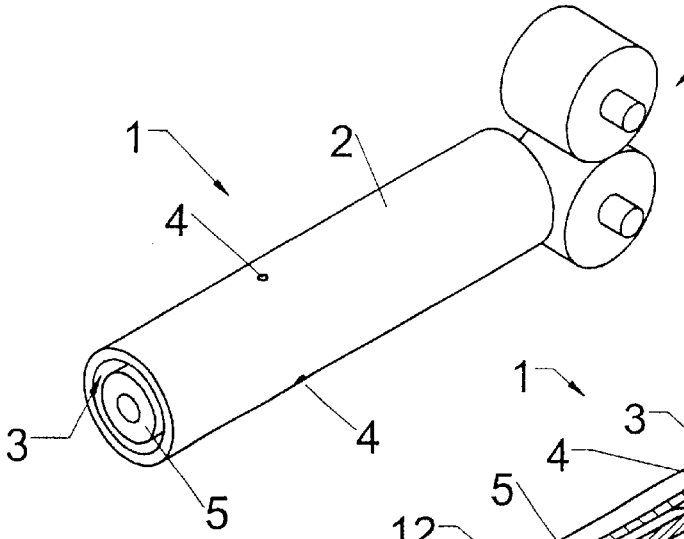
FIG. 1 a spinning apparatus shown schematically in a perspective view.

In the FIG. 1, a design example of an inventive spinning apparatus 1 is shown schematically and much simplified in a perspective view. Within a nozzle block 2 a substantially rotary symmetrical hollow room 3 is provided. In this hollow room 3 a spindle 5 is arranged. A feed device 15 serves for supplying fibre material into the hollow room 3 via a fibre guide duct 11 (compare the FIG. 2). Three jet nozzles 4 serve for supplying compressed air (or another suitable medium) in such a manner that inside the hollow room 3 an air stream is generated that essentially rotates tangentially.

Figure 2:
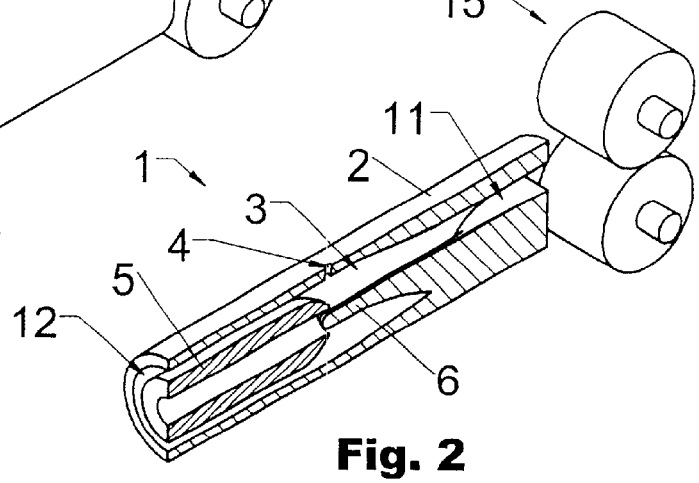
FIG. 2 a longitudinal section of the spinning apparatus according to the FIG. 1 in a perspective view.

In the FIG. 2 a much-simplified longitudinal section of the spinning apparatus according to the FIG. 1 is shown schematically. In the nozzle block 2, which here is shown cut open, the hollow room 3 is visible. In this hollow room 3 the three jet nozzles 4 are distributed along the circumference, arranged substantially tangentially with respect to a circular spindle 5 and a fibre guide means 6. The jet nozzles 4 serve for generating a tangentially rotating spiral air stream in the zone of the tip of the spindle 5, which also is shown cut, and the fibre guide means 6. The spindle 5 and the nozzle block 2 are separated by an air drain gap 12. The air drain gap 12 here is arranged concentric with respect to the spindle 5 and serves for draining air from the hollow room 3, the air brought into the hollow room 3 via the jet nozzles 4 being drained.

The fibre guide means 6 shown tapers off towards the spindle 5 and extends smoothly into a fibre guide duct 11. The fibre guide duct 11 serves for feeding fibres, e.g. of a fibre sliver (not shown in detail) from the feed device 15 into the hollow room 3. The fibre guide duct 11 here is arranged laterally offset with respect to the spindle 5. The duct in the zone where it merges into the hollow room 3 presents a substantially kidney-shaped cross-section. The fibres (not shown in detail) emerging from the fibre guide duct 11 are guided along the fibre guide means 6 in the direction towards the entry mouth of a spindle duct 8 of the spindle 5. The fibres around the fibre guide means in this arrangement are exposed directly to the rotating air stream generated by the jet nozzles 4, which exerts a force separating fibres from the fibre sliver. The leading portion of the fibres in this arrangement already form part of the yarn, from which the fibres cannot be separated easily under the influence of the force directed towards the outside. The trailing fibre ends, which are lifted off the fibre guide means, are arranged extending radially outwards. In the further course of the processing of the fibre sliver, the fibres consecutively are drawn into the spindle duct 8 in such a manner that a spun yarn with real twist is generated. For the quality and the characteristics of the yarn generated the layout and the form of the fibre guide duct 11 are of great importance.

Figure 3:
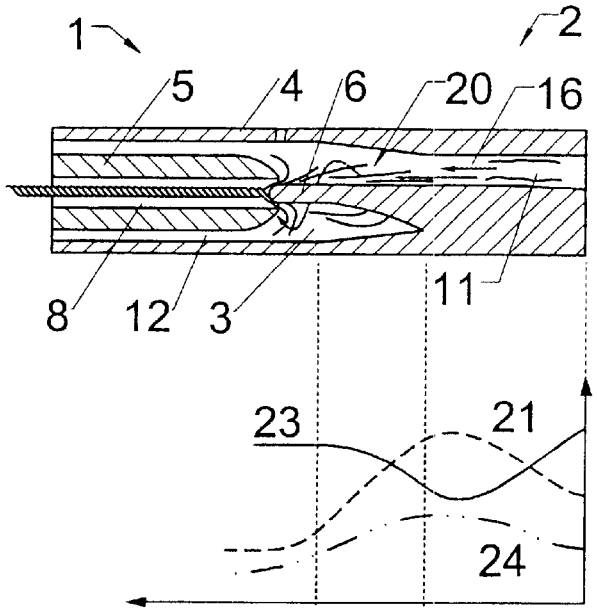
FIG. 3 a longitudinal section of the spinning apparatus according to the FIGS. 1 and 2 and, as an example, the variation of parameters over the length.

In the FIG. 3 a longitudinal section is shown of the spinning apparatus 1 according to the FIGS. 1 and 2. In the fibre guide duct 11 an air stream prevails, generated by an injector effect of the jet nozzles 4 and directed towards the interior of the nozzle block 2 (arrow 16). The form and the layout of the fibre guide duct 11 determine the air pressure and speed profiles to a great extent.

The speed and pressure profiles of the air stream along the fibre guide duct 11 are determined in such a manner that fibres 20 are prepared optimally for processing in the hollow room 3. The form of the fibre guide duct 11 can be laid out e.g. in such a manner that the fibres 20 in a first portion of the duct are straightened and oriented, and in a second portion of the duct are brought into a certain position relative to the duct cross-section in such a manner that they enter the hollow room 3 in controlled manner. The profile of the fibre guide duct 11 furthermore can be laid out e.g. in such a manner that the air stream is accelerated, or is slowed down respectively. Corresponding effects, concerning the situation of the fibres in the duct, are possible. By serial arrangement of corresponding duct portions the air stream, the arrangement and the distribution of the fibres is influenced in specific manner.

Depending on the layout of the fibre guide duct 11, an increase of the cross-sectional area along the duct causes a slow-down of the fibres (compare the FIG. 8.2) which thus tend to be crimped. If the cross-sectional area remains constant over a length portion, e.g. if merely the form of the cross-section changes, the fibres, owing to the change in form of the duct cross-section, which also influences the behaviour of the air stream, are transformed but are not significantly accelerated or slowed down (compare the FIG. 8.3).

If the cross-sectional area diminishes along the length the fibres are accelerated and thus are straightened (compare the FIG. 8.1). A diagram 22 (FIG. 3) here schematically shows a much simplified profile of the parameters in the fibre guide duct 11 in the sense of an example. A first curve 21 indicates a possible pressure profile along the length of the duct 11. A second curve 23 in the diagram 22 schematically shows a possible speed profile along the length of the duct 11.

In the FIG. 4 the spinning apparatus according to the FIGS. 1 through 3 is shown in a lateral view. The nozzle block 2 is shown with the jet nozzles 4 distributed along its circumference and the feed device 15. The positions of five sections G—G, through K—K are indicated with lines and arrows pointed to them at right angles. The arrows indicate the viewing direction. The sections are discussed in more detail with reference to the FIGS. 5.1 through 5.5.

In the FIGS. 5.1 through 5.5 the cross-sections G—G through K—K of the nozzle block 2 according to the FIG. 4 are shown. The fibres 20 fed in by the feed device 15 on their path to the hollow room (compare the FIG. 2) first pass through the cross-section G—G (FIG. 5.1) of the fibre guide duct 11. The cross-section G—G of the fibre guide duct 11 presents a circular wall section 30 and a straight wall 31. The fibres 20 in the illustration shown here hug the straight wall section 31.

In the FIG. 5.2 the cross-section H—H of the nozzle block 2 is shown. The cross-section of the fibre guide duct 11 here consists of the circular wall section 30 and of two straight wall sections 32 protruding into the duct cross-section, which merge with each other via a circular wall section 33. The fibres 20 in this case hug the two straight wall sections 32 and the circular wall section 33 connecting them. Inside the cross-section the horizon of the straight-line wall section according to the cross-section G—G is indicated.

In the FIG. 5.3 the cross-section I—I of the nozzle block 2 is shown. The fibre guide duct 11 here presents an essentially annular cross-section. The outer contour of the cross-section is formed by a semi-circular and a half-oval wall section 34. Inside the duct the fibre guide means 6 is indicated, which extends right into the fibre guide duct 11. It forms the drop-shaped inner contour of the fibre guide duct 11. The fibre guide duct 11 is laid out in such a manner that the fibres 20 in this duct portion substantially are arranged along the fibre guide means 6. As shown here in idealized manner the fibres 20 ideally form a fibre hose arrangement. Inside the cross-section of the straight-line wall section 31 according to the cross-section G—G is indicated in the background.

In the FIG. 5.4 the cross section J—J of the nozzle block 2 is shown. The fibre guide duct 11 here also presents an essentially annular cross-section. The outer contour of the cross-section is formed by a circular wall 34. Inside the duct the fibre guide means 6 is indicated, which here is of circular cross-section with a circular wall section 36. The fibres 20, shown schematically in much simplified manner, are arranged in a hose-type arrangement around the fibre guide means 6. The leading ends of the fibres 20 already are located in the spindle duct 8 (compare the FIG. 5.5) whereas the trailing ends of the fibres 20 are arranged spirally in the hollow room 3 (compare the FIG. 3) moving (not shown in more detail) with the rotating air stream (not shown) generated by the jet nozzles 4 (compare the FIG. 4).

In the FIG. 5.5 the cross-section K—K of the nozzle block 2 is shown. In its centre the fibre guide means 6 is indicated, the point of which extends right into the mouth zone of the spindle duct 8. The spindle 5 here is arranged in the hollow room 3 coaxially with, and opposite of, the fibre guide means 6. Between the spindle 5, which here also is shown in a cross-section, and the nozzle block 2 the draining gap 12 is indicated. The draining gap 12 serves, among other functions, for draining the air brought in via the jet nozzles 4. Inside the spindle duct 8 the fibres 20 now spun into a yarn are indicated.

The cross-sections shown in the FIGS. 51. through 5.5 of the fibre guide duct 11 and of the fibre guide means 6 present smooth profiles. The layout and the transition zones between the various portions influence the air stream conditions inside the nozzle block 2 in specific manner. Uncontrolled air stream breakdown and turbulences are avoided. In particular the transition zone between the fibre guide duct 11 and the fibre guide means 6 is smooth. The fibre guide means 6 in the design example shown here extends right into the fibre guide duct 11.

In the FIGS. 6 and 7 a further design example of an inventive spinning apparatus 1 is shown schematically in much simplified manner in a perspective view and in a perspective sectional view. The design of this spinning apparatus 1 essentially corresponds to the design example described with reference to the FIGS. 1 through 5.5. Differing from the latter, however, are the hollow room 3, as well as the layout of the fibre guide duct 11, which influences the process. The effect of this layout of the hollow room 3 and of the fibre guide means 6 is described in the following.

The nozzle block 2 in its inside contains an essentially rotary symmetric hollow room 3, in which a spindle 5 is arranged. A feed device 15 serves for feeding fibre material into the hollow room 3 via a fibre guide duct 11 (compare the FIG. 2). Jet nozzles 4 serve for feeding compressed air (or of another suitable medium) in such a manner that inside the hollow room 3 an air stream is generated rotating essentially tangentially. The spindle 5 and the nozzle block 2 are separated by an air-draining gap 12. The air-draining gap 12 here also is arranged concentric with the spindle 5, and serves for draining the air brought into the hollow room 3 via the jet nozzles 4.

The fibre guide means 6 tapers off towards the spindle 5 and smoothly extends, seen in the direction of fibre transport, back right into the fibre guide duct 11. The fibre guide duct 11 in this arrangement in the merging zone is arranged laterally offset with respect to the spindle 5. In the transition zone into the hollow room 3 the duct presents an essentially oval cross-section.

In the FIG. 8.1 a longitudinal section of the spinning apparatus 1 according to the FIGS. 6 and 7 is shown. In the fibre guide duct 11 an air stream (arrow 16) prevails oriented towards the inside of the nozzle block 2. The profile and the layout of the fibre guide duct 11, of the fibre guide means 6, as well as of the hollow room 3 decisively determine the air pressure and speed profiles.

The air pressure and speed profile over the length of the fibre guide duct 11 is chosen in such a manner that fibres 20 with respect to their location are optimally prepared for processing in the hollow room 3. The form and the profile of the cross-section are chosen in such a manner that the fibres 20 are accelerated in a controlled manner from a speed v2 (compare the FIG. 10) at the entry of the fibre guide duct 11 to a speed v1. This tends to straighten the fibres. These interactions are visualised in a diagram 22. The profile changes along the duct length of the cross-sectional area 24, of the pressure profile 21 and of the speed 23 are indicated.

In the FIGS. 8.2 and 8.3 two further profiles of the parameters over the fibre guide duct 11, and the nozzle block respectively, are indicated.

In the arrangement shown in the FIG. 8.2 the air speed decreases steadily from v2 to v1, whereas the cross-sectional area 24 and the pressure profile 21 steadily increase.

In the arrangement shown in the FIG. 8.3 the air speed (v2=v1), the cross-sectional area 24 and the pressure profile 21 remain constant.

In the FIG. 9 the spinning apparatus 1 according to the FIGS. 6 through 8 is shown in a side view. The position of five cross-sections G—G through K—K is indicated with lines and arrows pointed to them at right angles. The arrows indicate the viewing direction. The cross-sections are discussed in more detail in the following with reference to the FIGS. 10.1 through 10.5.

In the FIG. 10 the profile of the speed along the duct is shown schematically in much simplified manner as a function of the cross-sectional area in the fibre guide duct 11. FG through FJ designate the cross-sectional areas of the cross-sections G—G through J—J according to the FIG. 9.

In the FIGS. 11.1 through 11.5 the cross-sections G—G through K—K of the nozzle block 2 according to the FIG. 9 are shown. The fibres 20 supplied by the feed device 15 on their path to the hollow room 3 (compare the FIG. 7) first pass the cross-section G—G (FIG. 11.1) of the fibre guide duct 11. The cross-section G—G of the fibre guide duct 11 presents an essentially half-moon-shaped cross-section, contoured by a circular wall portion 30 and a straight-line wall portion 31. The fibres 20 in the arrangement shown here hug the straight-line wall portion 31.

In the FIG. 11.2 the cross-section H—H of the nozzle block 2 according to the FIG. 9 is shown. The cross-section of the fibre guide duct 11 here consists of the circular wall portion 30 and two straight-line wall portions 32 protruding into the cross-section, which via a circular wall portion 33 merge into each other. The cross-section presents a symmetric kidney shaped cross-section area. Asymmetric cross-section areas are suitable if e.g. the air stream is to be influence specifically. The fibres 20 here hug the two straight-line wall portions 32 and the circular portion 33 interconnecting them. Inside the cross-section area the horizon of the straight-line wall portion according to the cross-section G—G is indicated.

In the FIG. 11.3 the cross-section I—I of the nozzle block 2 according to the FIG. 9 is shown. The fibre guide duct 11 here presents a drop-shaped outer contour 34. Inside the cross-section area the fibre guide means 6 is indicated, which extends right into the fibre guide duct 11. It forms the drop-shaped inner contour 35 of the fibre guide duct 11. The fibre guide duct 11 is laid out in such a manner that the fibres 20 in this duct portion are arranged 5 substantially along the fibre guide means 6. As indicated here in idealized manner the fibres 20 in the ideal case form a fibre hose. Inside the cross-section area the horizon of the straight-line wall portion 31 of the cross-section G—G is indicated in the background.

In the FIG. 11.4 the cross-section J—J of the nozzle block 2 according to the FIG. 9 is shown. The fibre guide duct 11 here also present an essentially annular cross-section. The outer contour is formed by the circular wall 34. Inside the cross-section area the fibre guide means 6 is indicated, which here presents a circular cross-section. The fibres 20 shown schematically in much simplified manner are arranged in a hose-type arrangement around the fibre guide means 6. The leading ends of the fibres 20 already are located in the spindle duct 8 (compare the FIG. 11.5) whereas the trailing ends of the fibres 20 in the hollow room 3 (compare FIG. 3) are arranged spiraling, moving with the rotating air stream 26 (not shown) generated by the jet nozzles 4 (compare the FIG. 4).

In the FIG. 11.5 the cross-section K—K of the nozzle block 2 is shown. At the centre the fibre guide means 6 is indicated, the front end of which extends right into the entry mouth zone of the spindle duct 8. The spindle 5 here is arranged opposite the fibre guide means 6. Between the spindle 5, also shown in its cross-section, and the nozzle block 2 the air-draining gap 12 is indicated. The air-draining duct 12 serves, among other functions, for draining the air brought in via the jet nozzles 4. Inside the spindle duct 8 the fibres 20 spun into a yarn are indicated.

The cross-sections shown in the FIGS. 11.1 through 11.5 of the fibre guide duct 11 and of the fibre guide means 6 present smooth profiles. The form of the transition zones between the various positions specifically influences the air stream conditions inside the nozzle block 2. Aerodynamically advantageous layout, particularly of the fibre guide duct 11, and of the hollow room 3, prevents uncontrolled air stream breakdowns and turbulences.

It should be apparent to those skilled in the art that various modifications can be made to the embodiments of the invention shown and described herein without departing from the scope and spirit of the invention as set forth in the appended claims.

What is claimed is:

1. A pneumatic spinning apparatus for producing a spun yarn from fibers supplied thereto, said spinning apparatus comprising:

a nozzle block defining a hollow room therein;

a spindle having an inlet end disposed within said hollow room;

at least one jet nozzle disposed for generating a rotating air stream within said hollow room;

a fiber guide member disposed opposite from said spindle, said fiber guide member having a shape so as to act as a false core for fibers within said rotating air stream that are conveyed into said spindle;

a fiber guide duct defined within said nozzle block through which fibers are conveyed to said fiber guide member and said spindle, said guide duct merging into said hollow room;

wherein said fiber guide duct comprises a variable cross-section along the length thereof; and wherein said fiber guide duct comprises a surface along which fibers are guided therethrough, said surface merging into said fiber guide member.

2. The spinning apparatus as in claim 1 wherein said fiber guide duct comprises a varying shape with a generally constant cross-sectional area along its length.

3. The spinning apparatus as in claim 1 wherein said fiber guide duct increases in cross-sectional area along its length in a direction of fiber conveyance therethrough.

4. The spinning apparatus as in claim 1 wherein said fiber guide duct decreases in cross-sectional area along its length in a direction of fiber conveyance therethrough.

5. The spinning apparatus as in claim 1 wherein said fiber guide duct comprises a cross-sectional shape such that a fiber conveying fluid medium moving therethrough accelerates along the length of said fiber guide duct.

6. The spinning apparatus as in claim 1 wherein said fiber guide duct comprises a cross-sectional shape such that a fiber conveying fluid medium moving therethrough decelerates along the length of said fiber guide duct.

7. The spinning apparatus as in claim 1 further comprising an air drain defined between said spindle and said nozzle block for draining air introduced into said hollow room from said jet nozzle.

8. The spinning apparatus as in claim 1 wherein said fiber guide duct comprises an oval cross-sectional shape along at least a portion of its length.

9. The spinning apparatus as in claim 1 wherein said fiber guide duct comprises a circular cross-sectional shape along at least a portion of its length.

10. The spinning apparatus as in claim 1 wherein said fiber guide duct comprises an annular-segment cross-sectional shape along at least a portion of its length.

11. The spinning apparatus as in claim 1 wherein said fiber guide duct comprises a kidney-shaped cross-sectional shape along at least a portion of its length.

12. The spinning apparatus as in claim 1 wherein said fiber guide duct comprises a heart-shaped cross-sectional shape along at least a portion of its length.

13. The spinning apparatus as in claim 1 wherein said fiber guide duct comprises a sickle-shaped cross-sectional shape along at least a portion of its length.

14. The spinning apparatus as in claim 1 wherein said fiber guide duct comprises a half-moon shaped cross-sectional shape along at least a portion of its length.

15. A pneumatic spinning apparatus for producing a spun yarn from fibers supplied thereto, said spinning apparatus comprising:

a nozzle block defining a hollow room therein;

a spindle having an inlet end disposed within said hollow room;

at least one jet nozzle disposed for generating a rotating air stream within said hollow room;

a fiber guide member disposed opposite from said spindle, said fiber guide member having a shape so as to act a false core for fibers within said rotating air stream that are conveyed into said spindle;

a fiber guide duct defined within said nozzle block through which fibers are conveyed to said fiber guide member and said spindle, said guide duct merging into said hollow room; and wherein said fiber guide duct comprises a surface along which fibers are conveyed through said duct, said surface merging directly and continuously into said fiber guide member.

16. The spinning apparatus as in claim 15 wherein said surface tapers symmetrically into said fiber guide member.

17. The spinning apparatus as in claim 15 wherein said fiber guide member is coaxially disposed relative to said spindle inlet.

* * * * *